US005883577A

United States Patent [19]

Jordan et al.

[11] Patent Number: 5,883,577

[45] Date of Patent: Mar. 16, 1999

[54] MULTI STATION SMOKE DETECTORS

[75] Inventors: Patrick Pierre Jordan; Eric Allan Mims, both of Akron, Ohio

[73] Assignee: Energy & Technology Incorporated, Akron, Ohio

[21] Appl. No.: 46,080

[22] Filed: Mar. 23, 1998

Related U.S. Application Data

[63] Continuation-in-part of Ser. No. 863,735, May 27, 1997, abandoned.

[51] Int. Cl.[6] ..... G08B 17/10

[52] U.S. Cl. ..... 340/628; 340/577; 340/586; 340/600; 340/632; 340/636; 340/286.05; 340/333; 340/693.2; 340/693.4

[58] Field of Search ..... 340/628, 629, 340/630, 631, 632, 635, 636, 286.05, 577, 584, 586, 600, 333, 693.1, 693.2, 693.3, 693.4

[56] References Cited

U.S. PATENT DOCUMENTS 4,087,799 5/1978 Brouwer ..... 340/237.5

5,019,803 5/1991 Maram ..... 340/539

*Primary Examiner*—Nina Tong

[57] ABSTRACT

A smoke detector that comprises three different power sources. First one is the 110/220 volt AC house current, through a step down transformer or that can be hard wired into the home or factory. Second one is a moveable 9 volts rechargeable backup battery. Third one is a solar cell array with a plastic lens that provides up to 9 volts of current through a trickle charger/voltage regulator. The trickle charger also used to recharge the backup battery. With the trickle charger, the solar cell array can cause the smoke detector to alarm with only enough ambient light. The instant invention of the smoke detector unit overcomes the limits of the now market available smoke detectors, by being adjustable, moveable providing more current via the solar cell array to provide a complete recharge to the backup battery. Any voltage lower than 9 volts will lower the charge of the 9 volt rechargeable battery to the current 8 volts to 8 volts and so on up to 9 volts. So it is seen that a unit that does not have a voltage regulator system, cannot provide complete protection. This system will also overcome the need for a skilled person to install the unit.

14 Claims, 3 Drawing Sheets

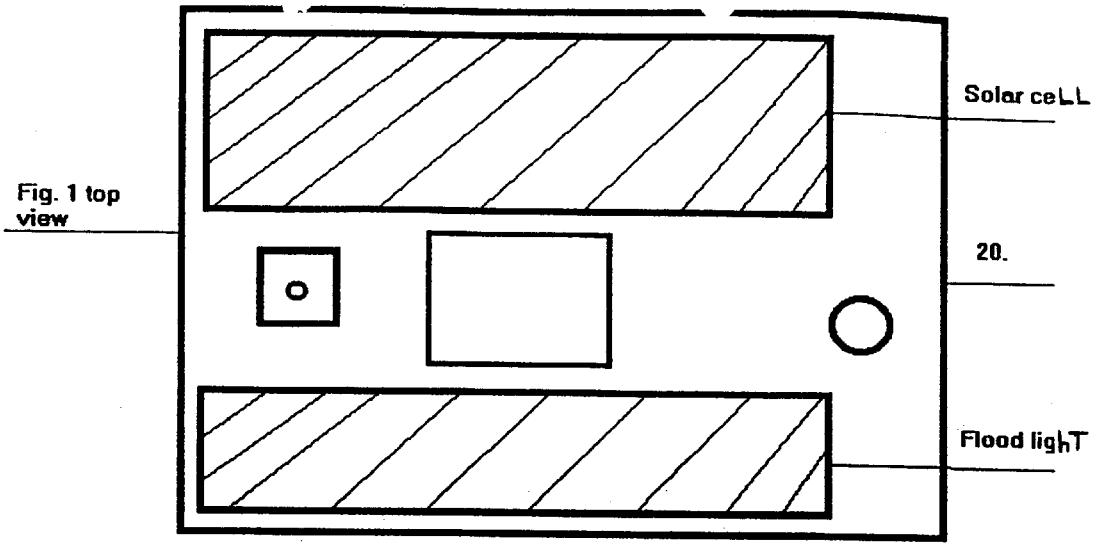
Fig. 2 inside view
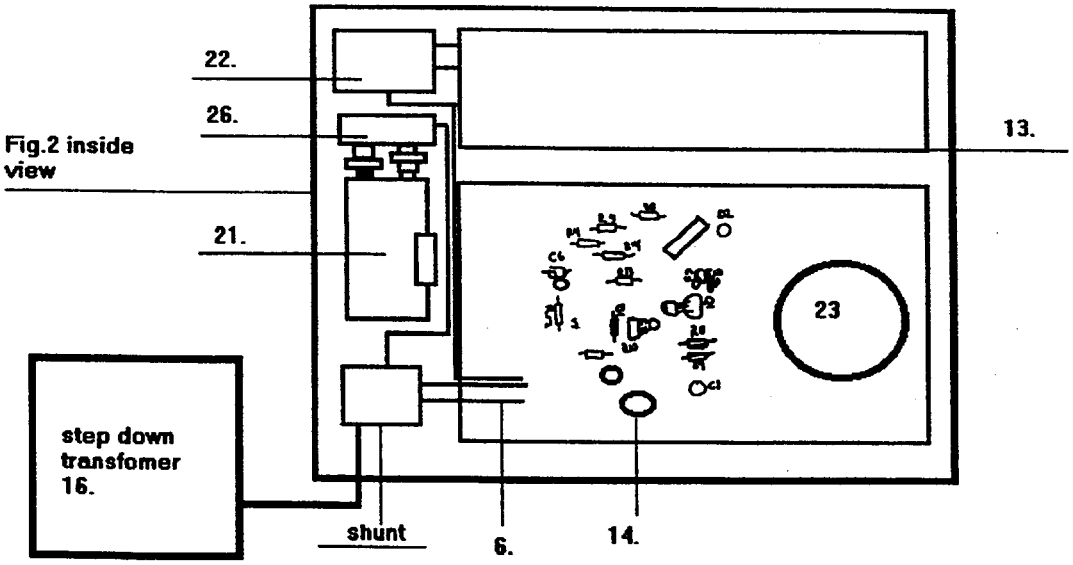

Fig 3. front view
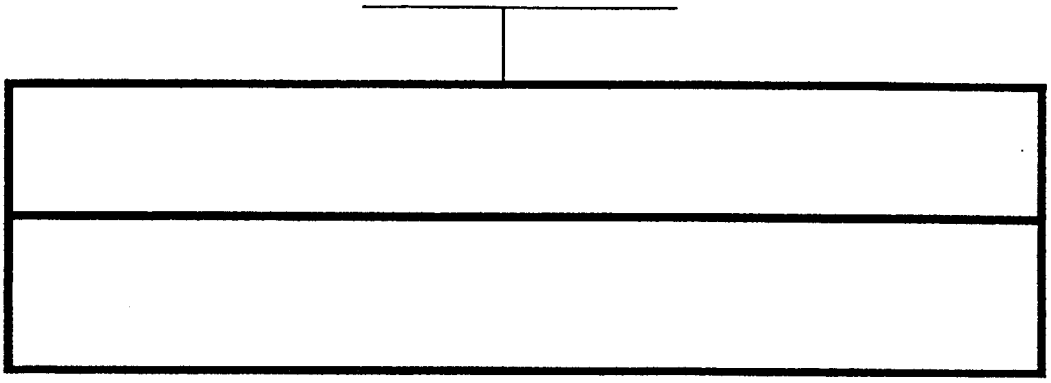
Fig. 4 bottom view
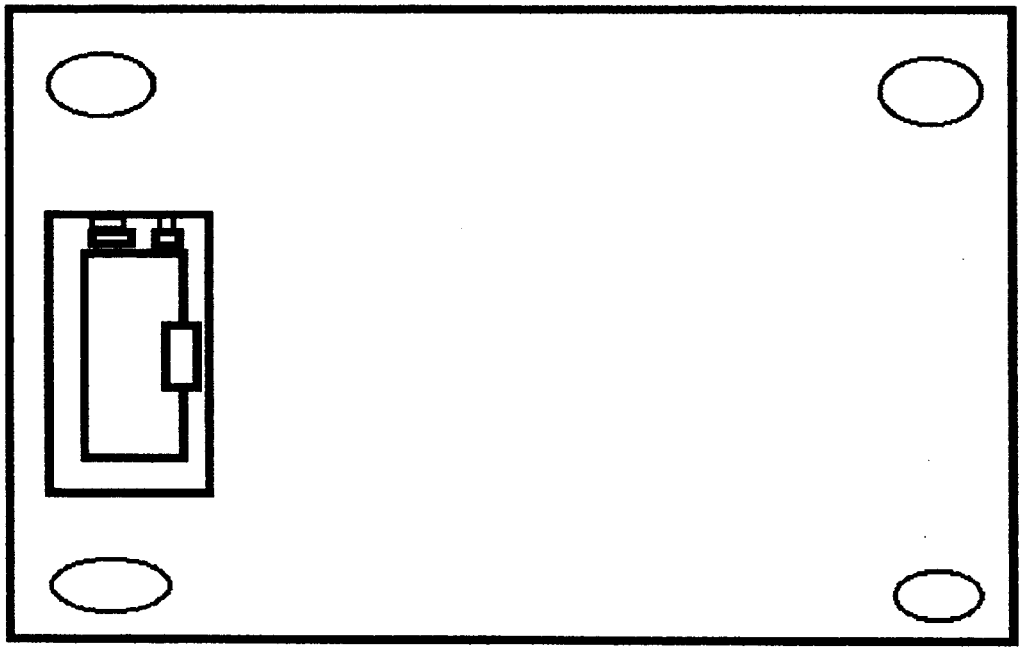

MULTI STATION SMOKE DETECTORS

This Application is a continuation-in-part (CIP) of the application Ser. No. 08/863,735, filed May 27, 1997, which is now abandoned.

This invention relates to smoke detector units for use in detecting unauthorized fire in living areas.

BACKGROUND OF THE INVENTION

Detector units for use in detecting unauthorized fire in homes, offices, factories and other buildings are well-known. These units normally comprise a detector such as hardwired detectors, battery powered detectors and the like and a signaling unit that emits a signal when the detector is actuated by e.g. detecting an untoward occurrence. The detector thereby alerts those with in range of said detector of a possible fire or smoke related emergency thereby saving lives.

Many if not most of these detectors are normally battery operated, but some are connected by wire connectors to the main power source e.g. 110/220 volt house current. Thus, the installation of the detector unit is a skilled operation requiring skilled workers to prepare the installation. Further, once the detector unit is installed, it is difficult to reposition without causing damage to the wall or other part on which it is mounted and along which the wires run. Also, the units as proposed by some do not have the option of a plug in 110/220 step down transformer or of being hardwired into the home as well as the lack of a backup system that fully protects the user, e.g. an electrical fire shuts down the power available from the 110/220 hardwired system or step down transformer. It has been proposed that the units should remain battery driven which avoids many of the problems mentioned above. However, such detector units have been on the market for a long time and are widely accepted but, new ways are being sought due to the fact that when the battery loses power, the zone covered by the detector units are often unsurveyed, leaving the user unprotected. In practice with smoke detectors of acceptably moderate cost, the units will have a limited range of detection making it necessary to have more than one unit, as the normal range will be for example one floor in home or the sleeping quarters of the home, the kitchen the storage room in a factory. The units when arranged in such a way can provide protection some detector units now available provide a battery back up system but no way to recharge the battery and if such a system is available it cannot fully charge the back up battery.

An object of the invention is to provide a detection which is capable of overcoming one or more of the foregoing disadvantages.

SUMMARY OF THE INVENTION

According to one aspect of the invention, there is provided a detector unit comprising a detector a signaling means in the form of a speaker that is connected to the detector and that sounds an audible alarm when the detector is actuated and battery means to power the detector and speaker characterized in that the battery is the backup source of power. The main source of power is the 110/220 volt step down transformer which steps down the 110/220 volt house current, to usable 9 volts for use by the smoke detector, power control means actuable when the power of the 110/220 volt step down transformer is not available.

Lost of main power warning indicator means, such as a chirp of short audible signal, is provided which is different than the alarm signal. So that the latter can provide an indication that the power of the 110/220 volt step down transformer is not available, and the 9 volt rechargeable battery power has dropped below a certain minimum. This signal may be given by a light emitting diode, a signal on a display device, an audio signal or other signal that alerts the user of possible power failure.

The detector unit will further comprise a solar cell array to recharge the 9 volt rechargeable battery. The solar cell array providing up to 9 volts of current to a trickle charger which will provide up to 9 volts to the 9 volt rechargeable battery, and can if needed provide the detector unit the power needed to sound alarm. The solar cell array may be separated from the unit by wire leads and reconnected to the unit by connection clips located in the housing unit.

The detector unit is contained within the housing into which is formed a test button to test the alarm function of the detector unit. On depression of this button the detector unit will emit a test signal (hereinafter called an "alarm signal") which is the same as the detector unit signal.

The smoke detector unit is preferably connected to the main power supply by the 110/220 volt step down transformer. It may be used without the 110/220 volt step down transformer by using, the 9 volt rechargeable battery and the solar cell array.

The detector units may be positioned as desired by the user, by untrained personnel or even on a "do-it-yourself" basis. To this end, the housing for each detector unit may comprise screws, nails etc., to secure the unit to the wall or ceiling. This method is provided with the unit.

There are two embodiments of the invention will now be described by way of example with reference to the accompanying drawings.

BRIEF DESCRIPTION OF THE DRAWINGS

FIG. 1 is a top view of the alarm system of the invention of the first embodiment.

FIG. 2 is a detail of the alarm system of FIG. 1.

FIG. 3 is a side view of FIG. 1.

FIG. 4 is a bottom view of FIG. 1.

DETAIL DESCRIPTION OF THE INVENTION

Figure 5:
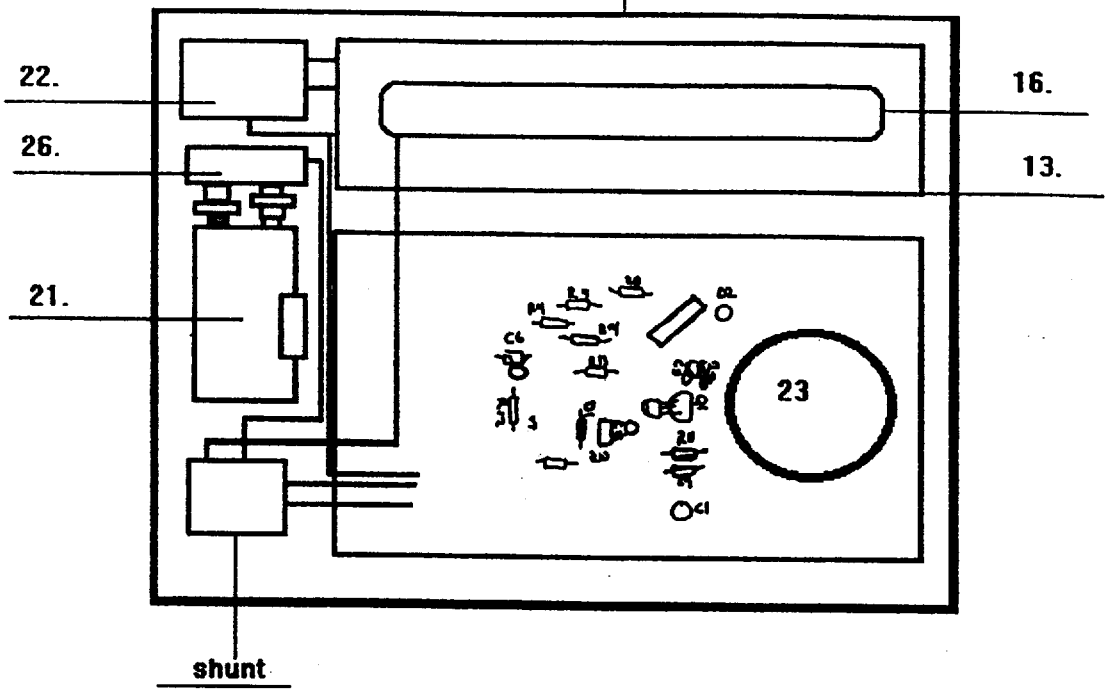
FIG. 5 is a detail of the alarm system of the invention of the second embodiment.

Referring now to FIGS. 1 to 4, there is shown the first embodiment of the alarm system of the invention. The system comprises a smoke detection unit 20 located in e.g. a home. It connects to a main source of 110/220 volt electrical power and to an rechargeable 9 volt battery 21. The battery 21 comes into operation whenever the main source of power is interrupted. A trickle charger/voltage regulator adjustable unit 22 is connected to the rechargeable 9 volt battery 21 to maintain it charged at all times. The trickle charger/voltage regulator adjustable unit 22 is connected to the solar cell array 13. It receives up to 9 volts from the array 13 and provides a continual charge of up to 9 volts. The trickle charger/voltage regulator adjustable unit will provide enough power to the main detector unit to sound alarm, in the event of power failure, e.g. 110/220 volt step down transformer 16 is not operating, and the 9 volt rechargeable battery has been removed or damaged, as the main detector unit 19 will sound alarm with the minimum of 9 volts of electrical power. The smoke detection unit includes an internal siren 23, a flood light 14, a series of identified LED's 24, which indicates the type of the power source is operating the main detector unit 19.

A test button is stationed on the unit for testing the system and alarm signal of the main detector unit 19. The test button is approximate the size of a thumb and raised for easy use.

The solar cell array 13 and trickle charger/voltage regulator adjustable unit 22 are described as follows. Power from the solar cell array 13 is gained from light sources in the home, factory, kitchen etc. The array 13 provides up to 9 volts to the trickle charger/voltage regulator adjustable unit 22 which provides up to 9 volts to the rechargeable battery 21 directly. The trickle charger/voltage regulator adjustable unit 22, which in the event of emergency, powers the detector unit 19. The trickle charger/voltage regulator adjustable unit 22 set to hold voltage at, for example 9 volts, of output to the rechargeable battery 21. All systems are on constant charge as this system is designed to alarm without fail. To do so a minimal of 9 volts is needed at all times to sound alarm.

When the main power system 6 loses power, the voltage will drop. When this has occurred, the backup battery 21 will power the unit. Thus, there will be an effective switch from main power 6 to the backup battery system 21, which will now supplement or replace the main power system 6 until the system can be restored. The backup battery system 21 will be charged and effective in such a switch from main power 6, due to the constant recharge of the system from the solar cell array 13 through the trickle charger/voltage regulator unit 22. In the event that the backup system 21 is removed or damaged, the system can be powered by the trickle charger/voltage regulator unit 22, which under normal use will have up to 9 volts of stored energy, from the solar cell array 13, provided that the solar cell array receives enough ambient light. It will be seen that as many living areas and zones can be protected by the system thus described. There will be a detector unit 19 for every living area zone and/or room, where fire protection is needed. Thus, in the event of an untoward occurrence, the user will be alerted to such, and will have a greater chance of survival.

As mentioned above, the above units have a 9–20 foot cord for the plug in step down transformer 16. Thus, the detector unit 19 can easily be installed by relatively unskilled staff, simply by installing the unit near a electrical outlet and plugging the step down transformer 16 into it. Furthermore, the unit can be operated without the step down transformer 16 increasing the usability of the unit. However, maximum safety may be compromised, as the main source of 110/220 volt electrical power 6, will not be available, leaving only three sources of power the solar cell array 13, the rechargeable battery 21, and the trickle charger/voltage regulator unit 22.

It is appreciated that the detector unit 19 will draw power from the systems available at a low voltage rate, until the detector unit 19 detects an untoward occurrence, and is to provide an audible alarm as well as power the flood light. Consequently, only very little power is drawn from the power systems and from the 9 volt rechargeable battery 21, which as a result of the constant trickle charge when needed, as the battery 21 will not charge unless needed. The battery has a longer life than in other systems now available. It is also appreciated that in the result of a main power failure, the flood light may not be available, and if available the duration of availability of the flood light and siren can not be determine.

Referring now to FIG. 5, there is shown the second embodiment of the invention. FIG. 5 shows the second trickle charger/voltage regulator adjustable unit 26 is connected to the 110/220 volt step down transformer 16. The second trickle charger/voltage regulator adjustable unit 26 receives up to 9 volts from the 110/220 volts step down transformer 16 via a shunt conductor. The shunt splits the current input of the 110/220 volt step down transformer 16, from 18 volts to 9 volts into two directions. One to the second trickle charge/voltage regulator adjustable unit 26 and the other one as the main power source to the detector unit itself 19. Both at a current of 9 volts and provides a continual charge of up to 9 volts. The second trickle charger 26 will provide enough power to the 9 volt rechargeable battery 21 to provide enough current to power the main detector unit to sound alarm in the event of power failure, e.g. 110/220 volt step down transformer 16 is not operating. If the rechargeable battery 21 is not operating, then the solar cell array will provide power to the detector unit 19 via the first trickle charger 22. The smoke detection unit includes an internal siren 23, a flood light 14, a series of identified LED's 24, which indicates the type of the power source is operating the main detector unit 19.

A test button is stationed on the unit for testing the system and alarm signal of the main detector unit 19. The test button is approximate the size of a thumb and raised for easy use.

The solar cell array 13 and the first and second trickle charger/voltage regulator adjustable units 22,26 are described as follows. Power from the solar cell array 13 is gained from light sources in the home, factory, kitchen etc. The array 13 provides up to 9 volts to the smoke detector unit 19 via the first trickle charger 22 with ambient light. Thus, it can provide enough current to power the smoke detector unit in the case of main power failure. The second trickle charger/voltage regulator adjustable unit 26 which provides up to 9 volts to the rechargeable battery 21 directly. The second trickle charger/voltage regulator adjustable unit 26, which in the event of emergency, powers the detector unit 19 at night or when no light is available. The second trickle charger/voltage regulator adjustable unit 26 set to hold voltage at, for example 9 volts, of output to the rechargeable battery 21, to prevent under charging or power loss. All systems are on constant charge as this system is designed to alarm without fail. To do so a minimal of 9 volts is needed at all times to sound alarm.

When the main power system 6 loses power, the voltage will drop. When this has occurred, the backup battery 21 will power the unit. Thus, there will be an effective switch from main power 6 to the backup battery system 21, which will now supplement or replace the main power system 6 until the system can be restored. The backup battery system 21 will be charged and effective in such a switch from main power 6, due to the constant recharge of the system through the second trickle charger/voltage regulator unit 26. In the event that the backup system 21 is removed or damaged, the system can be powered by the solar cell array 13 via the first trickle charger 22, which under normal light will have up to 9 volts of stored energy.

It will be seen that as many living areas and zones can be protected by the system thus described. There will be a detector unit 19 for every living area zone and/or room, where fire protection is needed. Thus, in the event of an untoward occurrence, the user will be alerted to such, and will have a greater chance of survival.

As mentioned above, the above units have a 9–20 foot cord for the plug in step down transformer 16. Thus, the detector unit 19 can easily be installed by relatively unskilled staff, simply by installing the unit near a electrical outlet and plugging the step down transformer 16 into it. Furthermore, the unit can be operated without the step down transformer 16 increasing the usability of the unit. However, maximum safety may be compromised, as the main source of 110/220 volt electrical power 6, will not be available, leaving only two sources of power the solar cell array 13, the rechargeable battery 21.

It is appreciated that the detector unit 19 will draw power from the systems available at a low voltage rate, until the detector unit 19 detects an untoward occurrence, and is to provide an audible alarm as well as power the flood light. Consequently, only very little power is drawn from the power systems and from the 9 volt rechargeable battery 21, which as a result of the constant trickle charge when needed, as the battery 21 will not charge unless needed. The battery has a longer life than in other systems now available.

Many of the parts as described herein will not be physically separate parts, but will in fact be constituted by portions of integrated circuits. Therefore, the power systems can be integrated with existing detectors with small modifications to the existing unit.

The invention is not limited to the precise constructional details hereinbefore described or illustrated in the drawings. For example, different numbers of voltage may be provided, the location of the step down transformer 16 and solar cell array 13 may be different. Other that possible modifications will be apparent to those skilled in the art.

Instead of the detector being a radioactive smoke detector, it may be photovoltaic (a light sensitive electrical eye that sees the light of the fire and the density of the smoke in a room and sounds alarm).

What is claimed is:

1. A portable detector unit comprising:

a detector for providing an alarm signal via a signaling means when an event is detected;

wherein said signaling means providing an audible alarm signal by a siren;

a main power source provides 110/220 volts comprises a 110/220 volt step down transformer via a first trickle charger/voltage regulator adjustable unit;

wherein said detector unit is normally powered by the main power source when 110/220 volt current is available;

a backup power system comprising a 9 volt rechargeable battery;

wherein said rechargeable battery is on constant trickle charge by the first trickle charger/voltage regulator adjustable unit;

a solar cell array;

a switch means is operated at the loss of the 110/220 volts power from the step down transformer, the 9 volts rechargeable battery continues the operation of the unit without interruption in operation, as in an electrical fire when the 110/220 volt current is unavailable;

wherein said step down transformer provides up to 18 volts to a shunt, and from said shunt, the 18 volts splits into two 9 volts, one 9 volts of current to the first trickle charger, and from the first trickle charger/voltage regulator adjustable unit to the rechargeable battery at up to 9 volts constant charge; and an other 9 volts provides as the main power source to power the detector unit; and when both the power from the main power source and the backup battery are not available, the solar cell array provides the needed 9 volts of current via a second trickle charger to power the detector unit and sound the alarm.

2. The detector unit as claimed in claim 1, further comprising a LED display to indicate the type of the current power source from one of the power sources of the 110/220 volts from the main power source, the 9 volts from the backup power system, or the solar cell array.

3. The detector unit as claimed in claim 2, wherein said LED display is used for indicating that the unit is powered by either the backup power system or the solar cell array.

4. The detector unit as claimed in claim 1, wherein the detector unit could be hard wired to the AC power source by eliminating the step down transformer; and said detector unit is a fire or smoke detector unit which is mounted on the wall or ceiling.

5. The detector unit as claimed in claim 4, wherein said detector unit could be screwed into a light socket and used as a light.

6. The detector unit as claimed in claim 1, wherein said detector is either a radioactive detector or a photovoltaic detector.

7. The detector unit as claimed in claim 1, further comprising an industrial flood light.

8. A portable detector unit comprising:

a detector for providing an alarm signal via a signaling means when an event is detected;

wherein said signaling means providing an audible alarm signal by a siren;

a main power source provides 110/220 volts comprises a 110/220 volt step down transformer;

wherein said detector unit is normally powered by the main power source when 110/220 volt current is available;

a backup power system comprising a 9 volt rechargeable battery;

wherein said rechargeable battery is on constant trickle charge by a trickle charger/voltage regulator adjustable unit;

a solar cell array;

a switch means is operated at the loss of the 110/220 volts power from the step down transformer, the 9 volts rechargeable battery continues the operation of the unit without interruption in operation, as in an electrical fire when the 110/220 volt current is unavailable;

wherein the solar cell array that sends up to 9 volts of current to the trickle charger/voltage regulator unit and from the trickle charger/voltage regulator adjustable unit to the rechargeable battery at up to 9 volts constant charge; and when both the power from the main power source and the rechargeable battery are not available, the trickle charger/voltage regulator adjustable unit provides the needed 9 volts of current to power the detector unit and sound the alarm.

9. The detector unit as claimed in claim 8, further comprising a LED display to indicate the type of the current power source from one of the power sources of the 110/220 volts from the main power source, the 9 volts from the backup power system, or the solar cell array.

10. The detector unit as claimed in claim 9, wherein said LED display is used for indicating that the unit is powered by either the backup power system or the solar cell array.

11. The detector unit as claimed in claim 8, wherein the detector unit could be hard wired to the AC power source by eliminating the step down transformer; and said detector unit is a fire or smoke detector unit which is mounted on the wall or ceiling.

12. The detector unit as claimed in claim 11, wherein said detector unit could be screwed into a light socket and used as a light.

13. The detector unit as claimed in claim 8, wherein said detector is either a radioactive detector or a photovoltaic detector.

14. The detector unit as claimed in claim 8, further comprising an industrial flood light.

* * * * *